US005836842A

United States Patent [19]

McLearan

[11] Patent Number: 5,836,842

[45] Date of Patent: Nov. 17, 1998

[54] SCENT ARROW

[75] Inventor: Eddie Charles McLearan, Tulsa, Okla.

[73] Assignee: McLearan Farms, Inc., Tulsa, Okla.

[21] Appl. No.: 843,868

[22] Filed: Apr. 17, 1997

[51] Int. Cl.[6] ..... F41B 5/02

[52] U.S. Cl. ..... 473/581

[58] Field of Search ..... 473/581, 577, 473/218, 578; 604/130, 187

[56] References Cited

U.S. PATENT DOCUMENTS

| | | | |
|---|---|---|---|
| 3,701,533 | 10/1972 | Palmer | 473/577 |
| 4,093,229 | 6/1978 | Kelling | 473/577 |
| 4,726,584 | 2/1988 | Bishop | 273/418 |
| 4,881,743 | 11/1989 | Fiorenzo | 273/418 |
| 5,123,657 | 6/1992 | Colt et al | 273/418 |
| 5,183,259 | 2/1993 | Lyon | 273/418 |
| 5,202,533 | 4/1993 | Vandersteen | 102/512 |
| 5,269,535 | 12/1993 | Gagne | 273/420 |
| 5,295,971 | 3/1994 | Cameron | 604/187 |
| 5,437,641 | 8/1995 | Cameron | 604/130 |

*Primary Examiner*—Mark S. Graham
*Attorney, Agent, or Firm*—Head, Johnson & Kachigian

[57] ABSTRACT

An arrow for dispersing scent to attract game to be used by a bow hunter from a remote location. Said scent dispersing arrow having an improved means for holding the desired animal scent and for dispensing said scent upon the arrow's impact with a solid surface. Said arrow having a cylindrical cartridge for retaining the scent mounted within the forward end of said arrow's tubular shaft. The forward arrow end also having a two-piece containment means with a blunt pointed end with a rearward extending cylindrical piston, said piston pushing into the cylindrical cartridge upon impact and expelling the liquid scent through a passageway into the area of the arrow's impact, the arrow having an attachment means at its rearward end for a thin line, unreeled in flight, by which the arrow may be retrieved by the bow hunter, without leaving his position.

1 Claim, 3 Drawing Sheets

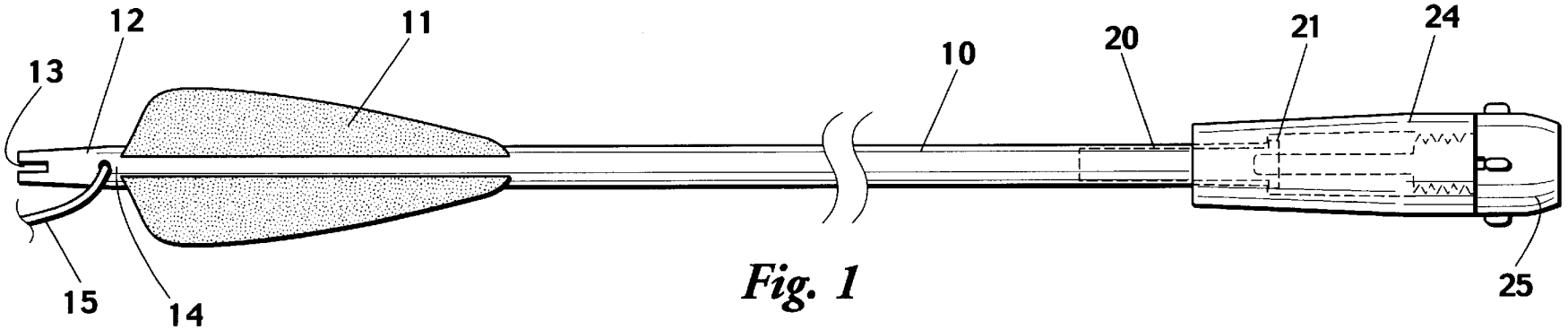
Fig. 1
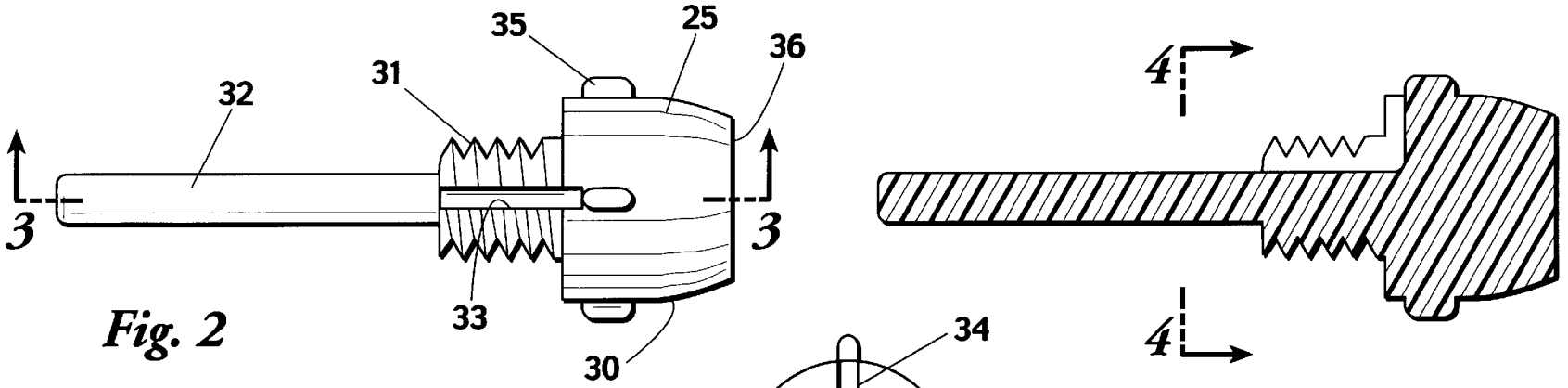
Fig. 2
Fig. 3
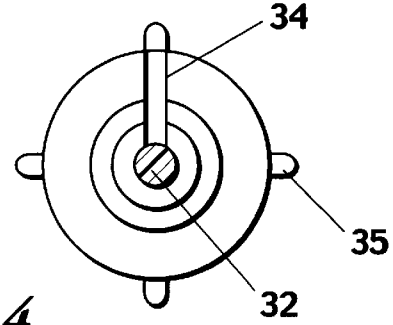
Fig. 4

SCENT ARROW

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

In the sport of bow and arrow hunting the typical means of hunting is for the hunter to select a spot believed to be in a path or other area where the game is likely to be and wait for the animal in a tree or other hiding place. To improve the hunters odds, an attractant such as the scent of such animal may be left in the area so that other animals of the species would investigate it and while doing so, offer more target opportunities for the hunter. In dispersing the animal scent it is important not to contaminate the area with the hunters own, i.e. human scent, as animals such as deer can discern such different scents and would avoid approaching.

An effective means of remote dispersal of animal scent is to use an arrow which is loaded with the desired scent and designed to emit or disperse the scent upon impact. Such an arrow may have a fine line attached to it so that the hunter once positioned in his post may shoot the arrow at a desired location away from his area and retrieve it, reload with additional scent and repeat the procedure until the hunter has dispersed the desired scent over the area in question.

Scent dispersing arrows have been described in existing patents including U.S. Pat. Nos. 4,881,743; 4,726,584 and 5,123,657. Both patents 4,881,743 and 4,716,584 use a filler material that is soaked with animal scent. In U.S. Pat. No. 5,123,657 a cartridge containing the scent is used and upon the arrow impacting the ground, the cartridge is penetrated by a sharp instrument allowing the scent to escape.

All the prior efforts have attempted to solve the problem of dispersing animal scent from a remote location yet each has fallen short in achieving the goal in an optimum economical fashion. The most recent patent mentioned, that is, U.S. Pat. No. 5,123,657, has a sealed cartridge container contained in the forward end of a hollow arrow shaft which is intended to be pierced by a sharp end opposite the blunt end of the arrow cap upon impact. The bow hunter, however, will find that the cartridge will be pushed back into the arrow shaft upon impact and lodged therein making the arrow unusable for a second shot in the field. Furthermore, the need to ream out the forward arrow shaft end in the prior invention increases the cost as does the requirement of a sharp pointed rearward end to the blunt cap.

The present disclosure overcomes the disadvantages of the prior art as explained above and provides an improved arrow for use by a bow hunter to attract game.

A better understanding of the invention will be obtained from the following description of the preferred embodiments, taken in conjunction with the attached drawings.

SUMMARY OF THE INVENTION

The arrow in this invention is a special purpose arrow for a bow hunter to utilize in dispersing scent to attract game. The arrow is in the form of an elongated arrow shaft with a front end and a rear end. The arrow shaft has a tubular portion adjacent to the front end although the entire arrow shaft may be tubular. The shaft is typically formed of a light weight metal such as aluminum or a metal alloy, composite or plastic which would have similar characteristic of light weight and strength.

The rear end of the arrow shaft is typically fitted with aerodynamic stabilizing means such as radially spaced fins and the end itself is fitted with an adapter having a slot or nock for mounting to the bow as well as a hole through which a retrieval line may be attached.

The forward end of the arrow shaft has a special two-piece member which is used to hold the scent container as well as the means for dispensing the scent upon launching the arrow. The scent container is a cylindrical container intended to fit snugly inside the arrow shaft, said container having a lip extending radially outward such that when it is inserted inside the arrow shaft it will not penetrate into the arrow shaft beyond the end thereof. The outer radius of the lip is designed to be slightly greater than the outer radius of the arrow shaft.

The two-piece member consists of a tubular collar which fits over the arrow shaft and is equipped with internal threads over its own forward end. The other piece forms the cap and is designed to have a blunt end at its forward end and threaded portion to be attached to the internal thread of the tubular collar and extending rearward from the threaded portion is a cylindrical plunger. The cap portion has an indent through the threaded portion and radially outward in the blunt end portion. Said indent providing a path for the liquid scent to exit the scent container.

In use the tubular collar would be mounted over the front end of the arrow shaft, the scent container then inserted into the arrow shaft, the liquid scent added to the container and the assembly closed by threading on the cap.

The hunter is then ready to shoot the arrow to the designated spot. Upon impact, the blunt end pushes the closure assembly rearward along the arrow shaft longitudinal axis. As it does so, the plunger portion of the cap penetrates into the liquid scent within the cylindrical container forcing the scent through the slit in the cap and out into the air and ground around the point of the arrow's impact.

The line attached to the rear end of the arrow having unreeled during flight, may now be used by the hunter to retrieve the arrow. Upon retrieval, the bow hunter unscrews the cap, pushes the tubular portion rearward along the arrow shaft to expose the cylindrical container. The container may then be refilled and the procedure repeated until the animal scent is distributed around the hunter as desired.

DESCRIPTION OF THE DRAWINGS

FIG. 1 shows a side view of the assembled scent arrow.

FIG. 2 shows the forward end closure member.

FIG. 3 shows an axially longitudinal cross-section of the forward end closure member.

FIG. 4 shows the forward end closure member from its rearward end illustrating the indent which the fluid scent escapes in operation.

DETAILED DESCRIPTION OF THE PREFERRED EMBODIMENTS

Figure 5:
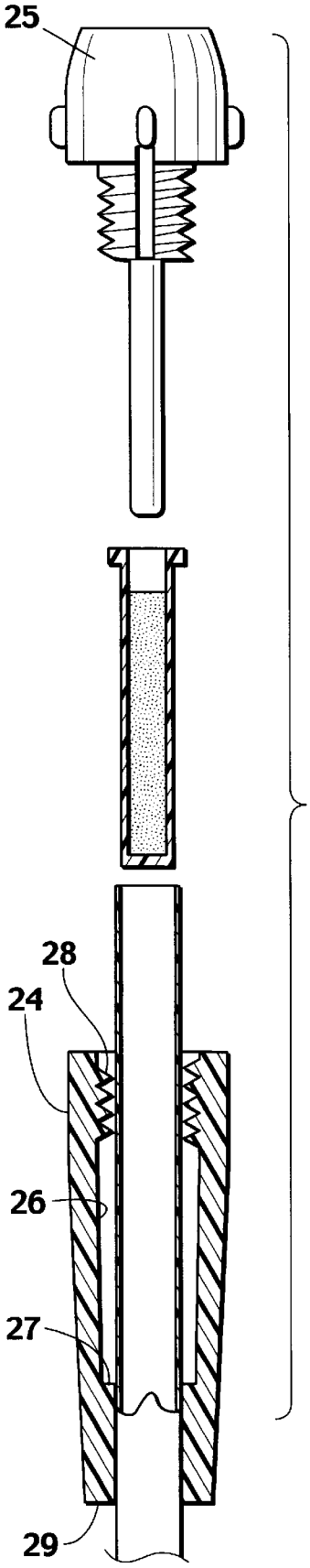
FIGS. 5, 6 and 7 show exploded views of the forward end of the scent arrow in the process of loading an assembly prior to firing of said scent arrow.

The improved scent dispensing arrow of this invention is designed around a hollow arrow shaft with specialized fittings at each of the forward and rearward ends of said arrow. As shown in FIG. 1, shaft 10 is a hollow shaft preferably of standard size as readily made for hunting arrows, most of such arrow shafts being commonly made of aluminum.

At the rearward end it is equipped with stabilizing fins 11 commonly plastic or other light material. The fins or fletching are affixed onto the outside of the arrow shaft in a radially symmetrical spacing. The rearward end has a plastic piece 12 which may be molded, said piece having a nock at its rearward end for centering the arrow on the bow string of the bow and a hole 14 forward of its rearward end through which a string or line 15 may be passed and secured. The line is attached to a tracker or reeling mechanism such that when the arrow is shot, it may be retrieved by the bow hunter by reeling in the line. The rearward end forward portion has a slightly smaller outside diameter that fits snugly inside the arrow shaft and is secured in place by an adhesive or other means.

The forward end of the arrow shaft rather than having a broad head or other arrow point is equipped with a special blunt pointed scent containment means made up of three pieces. The purpose of the forward end is to be a receptacle for liquid animal scent and after release of the arrow and subsequent impact with the ground or other solid object away from the bowman, the release of said scent from said receptacle.

As shown in FIG. 1, the forward end is made of three separate pieces, two outer pieces that are coupled to each other by means of mating threads and which are moveable axially along the longitudinal axis of the arrow shaft over a specified distance, and an internal tubular container or cartridge which is permanently affixed to the arrow shaft at the forward end thereof. For purposes of this disclosure, we will designate the outer two pieces, the closure assembly, comprised of the moveable outer portion 24 and a blunt pointed cap portion 25. The moveable outer portion 24 may be made of a plastic mold and is designated to slip over the forward end of the arrow shaft as shown in cross-section in FIGS. 5, 6 and 7. The moveable outer portion is cylindrical in shape with its rearward end having an inner diameter 29 of a size such as to fit snugly over the outer diameter of the arrow shaft. The remainder of the body of the moveable outer portion 24 has an inner diameter 26 that is larger than the outer diameter of the arrow shaft thus leaving a ring-shaped surface 27 on the inside of said moveable outer portion where the inner diameters change size.

At the forward end of the moveable outer portion 24 and on the inside thereof, a series of threads 28 are formed to allow threading of the blunt pointed cap portion 25. At the forward end of said moveable outer portion 24 radially spaced longitudinal rib extrusions may be added to provide a better grip when threading the blunt point cap portion 25 to the moveable outer portion 24, said ribbing is not shown in the figures.

Figure 6:
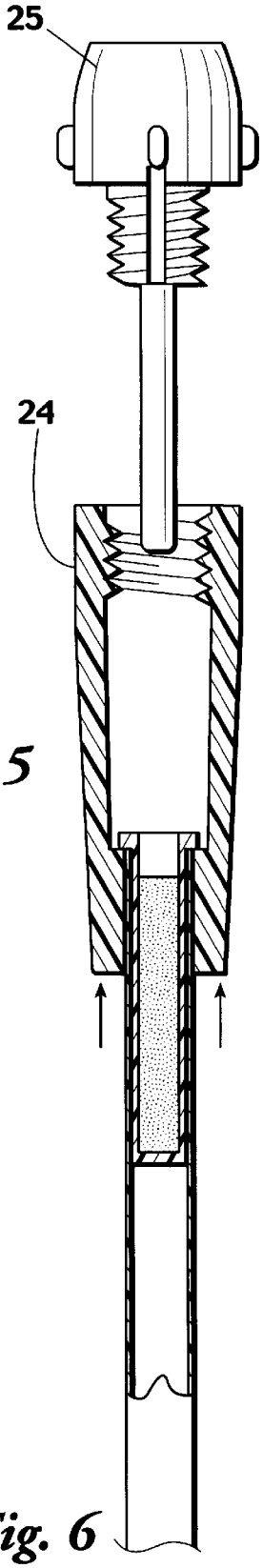
Figure 7:
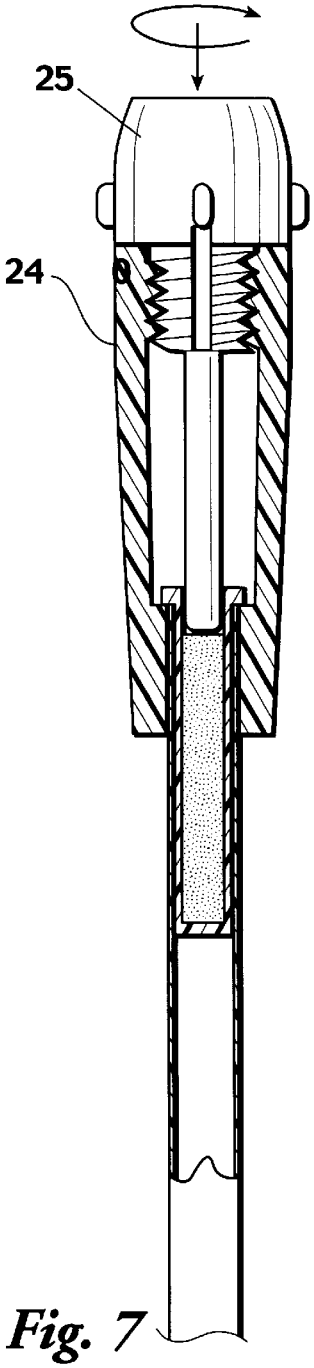
Figure 9:
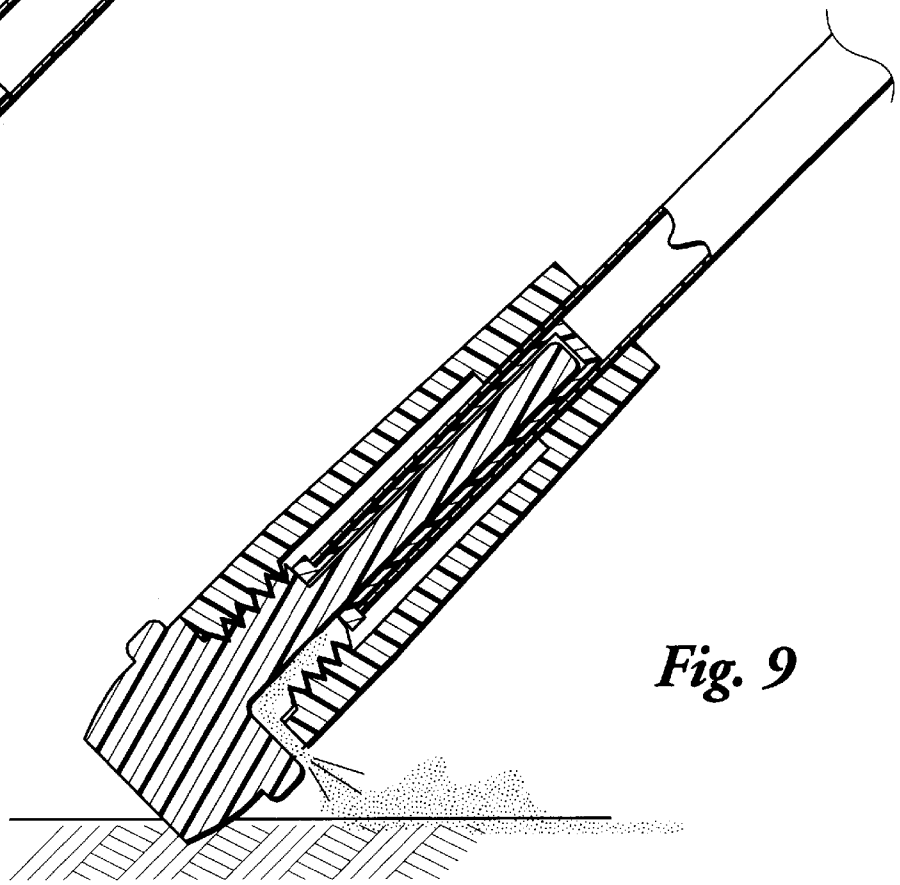
FIGS. 8 and 9 illustrate the effect on the forward end upon impact of the arrow with the ground.
Figure 8:
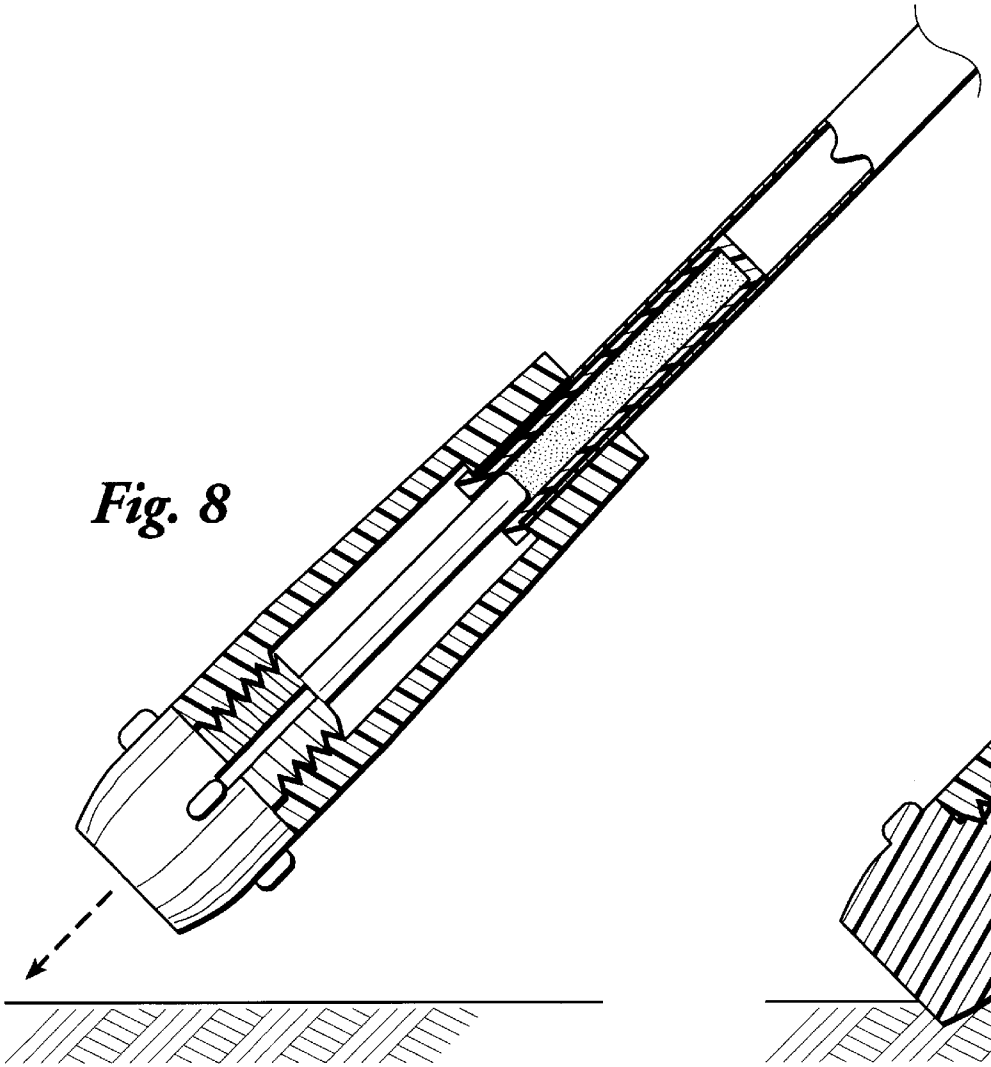

The forward end of the arrow shaft is equipped with a tubular container 20 for the liquid scent. Said container is formed of plastic or other like material and designed to be of an outer diameter to fit snugly within the inner diameter of the shaft. At its forward end, the container is open and has a lip or flange 21 extending radially outward said lip or flange having an outside diameter slightly greater than the outside diameter of the arrow shaft. At its rearward end, the container cartridge has a bottom such that it may hold liquids. The cartridge is inserted into the forward end of the arrow shaft and affixed thereto by an adhesive or other means. Prior to permanently affixing the cartridge to the arrow shaft, the moveable outer portion 24 is slipped over the arrow shaft. Once both the cartridge 20 and the moveable outer portion 24 are on the arrow shaft, the moveable outer portion 24 may be moved forward but only so far until the ring-shaped surface 27 reaches the flange 21 of the cartridge. In such forward extended position for the moveable outer portion, the scent arrow is ready for loading with liquid scent and it is in the extended forward position, as shown in FIG. 6, that the blunt pointed cap portion 25 is placed upon and threaded into the moveable outer portion as shown in FIG. 7.

The blunt pointed cap portion 25 is shown in FIG. 2. It is a one-piece plastic unit having three distinct segments, a forward cap end 30; a threaded segment 31 for mating with a moveable outer portion and a piston segment 32 at its rearward end. The outer diameter of the piston end Us such as to snugly and readily fit inside the inner diameter of liquid scent cartridge container as shown in FIG. 7. As shown in FIG. 2 there is a narrow slit 33 along the longitudinal axis of the blunt cap portion threaded segment 31 and penetrating beyond the threaded segment into the forward cap 30, whence the slit extends radially outward to the outside periphery of the forward cap segment 34 as shown in FIG. 4. These slits or narrow passageways allow the liquid scent to flow out of the cartridge container 20 under the pressure of the piston segment 32 penetrating into the cartridge container. The liquid will move forward along the slit 33 through the threaded segment 31 and thence radially outward through the radial slit 34.

The forward cap segment is also equipped with small protrusions or bumps 35 spaced radially about the periphery of the outer surface of said forward cap end to ease gripping while threading or unthreading. Said blunt pointed cap portion has a blunt or flat surface 36 at its forward end such that when the arrow is released and when it hits the ground or other solid objects, it does not penetrate but instead is pushed back along the arrow shaft causing the piston segment to penetrate the scent loaded cartridge and forcing the liquid scent out onto the surface through the slits.

The slits are designed such that the liquid scent will not leak out when the closure assembly is properly secured and extended to its forward position.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An improved scent dispensing arrow for use by a bow hunter for attracting game towards the hunter comprising:

an elongated tubular arrow shaft having a forward and a rearward end;

a formed rear member affixed to said rearward end of said arrow shaft; said rear member having a nock cut out at its rearward end to accommodate a bow string and a hole through its middle to allow securing a retrieval line to said arrow;

fletching affixed to the rearward end of said arrow shaft to provide aerodynamic stability to the arrow while in flight;

an elongated tubular cartridge having a rearward end and an opening at its forward end and having a lip or ring at its forward end, said cartridge affixed to said arrow shaft at its forward end such that said lip abuts against said forward end of said arrow shaft and extends radially outward slightly beyond the outer diameter of said arrow shaft;

a closure assembly comprised of two parts attachable to each other; said closure assembly comprising a moveable outer portion and a blunt pointed cap portion;

said moveable outer portion being a tubular segment having a first forward, a first rearward and a first middle segment, said first rearward segment having an inside diameter equal to said arrow shaft outside diameter yet allowing said moveable outer portion to be moveable along the forward end of said arrow shaft;

said first middle and first forward segments of said moveable outer portion of said closure assembly having an inner diameter greater than said outer diameter of said arrow shaft as well as said cartridge lip outer diameter;

said first forward segment of said moveable outer portion of said closure assembly further having threads on the inside thereof, said threads of a size to mate with threads on said blunt pointed cap portion of said closure assembly;

said blunt pointed cap portion of said closure assembly having a second forward, a second rearward and a second middle segment, said second rearward segment being a tubular piston with an outside diameter of a size to snugly fit inside said elongated tubular cartridge;

said second middle segment having a threaded portion, said threads being sized to mate with corresponding threads of said forward segment of said moveable outer portion;

a said second forward segment whose outside diameter is of a size equal to said moveable outer portion outside diameter and said second forward segment having a blunt end at a forward end;

said second middle segment threaded portion of said blunt pointed cap portion also having a narrow slit along the longitudinal axis thereof extending across the length of said second middle segment and into a rear end of said second forward segment where said slit extends radially outward along a rear surface of said second forward segment to an outer surface thereof.

* * * * *